US005875773A

United States Patent [19]

Jansen

[11] Patent Number: 5,875,773

[45] **Date of Patent: *Mar. 2, 1999**

[54] SAFETY DEVICE FOR A COOKING APPLIANCE

[75] Inventor: Gerardus Wilhelmus Jansen, Ulft, Netherlands

[73] Assignee: Atag Keukentechniek B.V., Ulft, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 602,305

[22] Filed: Feb. 16, 1996

[30] Foreign Application Priority Data

Feb. 17, 1995 [NL] Netherlands ..... 9500317

[51] Int. Cl.[6] ..... F24C 3/12

[52] U.S. Cl. ..... 126/42; 126/39 E; 431/18; 431/153

[58] Field of Search ..... 431/69, 78, 75, 431/71, 70, 25, 15, 18, 153; 126/39 E, 42

[56] References Cited

U.S. PATENT DOCUMENTS

| | | | |
|---|---|---|---|
| 2,216,534 | 10/1940 | Kirk | 431/48 |
| 2,431,158 | 11/1947 | Yates | 431/51 |
| 4,156,432 | 5/1979 | Helwig, Jr. | 431/78 |
| 4,930,488 | 6/1990 | Pearman et al. | 126/39 E |
| 5,099,822 | 3/1992 | Cramer et al. | 126/39 E |
| 5,161,963 | 11/1992 | Berlincourt | 431/78 |
| 5,241,463 | 8/1993 | Lee | 126/39 E |
| 5,244,379 | 9/1993 | Stirling et al. | 431/15 |
| 5,425,631 | 6/1995 | Krueger et al. | 431/6 |
| 5,439,111 | 7/1995 | Akamatsu | 126/39 BA |

FOREIGN PATENT DOCUMENTS

| | | | |
|---|---|---|---|
| 4003799 | 4/1991 | Germany | F24C 3/12 |
| 0033425 | 2/1985 | Japan | 431/15 |
| 406213424 | 8/1994 | Japan | 431/18 |
| 406213434 | 8/1994 | Japan | 126/18 |
| 9314250 | 7/1992 | WIPO | F24C 3/12 |

OTHER PUBLICATIONS

Intel, Microcontroller Handbook, Intel corporation, pp. 1–1 to 1–4, 2–1 to 25, 1985.

Translation –Safety Device for Burning Implement, JP 406213434, UCHIDA, Aug. 1994.

Abstracts of Japan, vol. 18, No. 628 (M–1713), Aug. 1994.

Abstracts of Japan, vol. 12, No. 343 (M–741), Sep. 1988.

*Primary Examiner*—Carl D. Price

*Attorney, Agent, or Firm*—Webb Ziesenheim Bruening Logsdon Orkin & Hanson P.C.

[57] ABSTRACT

A device for protecting a cooking appliance, in particular a gas cooking plate or a gas cooker, with at least one gas burner which is connected to a gas main via a branch pipe and which is provided with a manually operated gas tap for opening and closing the branch pipe and an ignition mechanism, wherein the or each burner is provided with a sensor for detecting a gas flame, wherein a central processor is arranged which is connected to this sensor and which actuates a gas valve accommodated in the gas main, this such that the gas valve closes in the absence of a flame at the burner, whereby unsafe situations are prevented.

6 Claims, 2 Drawing Sheets

SAFETY DEVICE FOR A COOKING APPLIANCE

BACKGROUND OF THE INVENTION

1. Field of the Invention

The invention relates to a device for protecting a cooking appliance, in particular a gas cooking plate/gas cooker, with at least one gas burner which is connected to a gas main via a branch pipe and which is provided with a manually operated gas tap for opening and closing the branch pipe and an ignition mechanism.

2. Description of the Prior Art

Such cooking appliances are usually embodied with two or more burners, wherein the ignition of the flame at the burner takes place by means of a standard external spark ignition transformer with a branch leading to each burner, wherein the ignition takes place simultaneously at all burners. Such an ignition transformer is placed in active position and provided with an ignition signal by a manual control, whereupon the ignition transformer will immediately spark. Ignition takes place when one of the gas taps is opened, whereafter the ignition is manually rendered inoperative.

SUMMARY OF THE INVENTION

The invention has for its object to provide such a cooking appliance with a safety device, this such that in the case of an error in the system no dangerous situation occurs.

The device according to the invention is distinguished in that each burner is provided with a sensor for detecting a gas flame, wherein a central processor is arranged which is connected to this sensor and which actuates a gas valve accommodated in the gas main, this such that the gas valve closes in the absence of a flame at the burner.

Owing to the use of the central processor a feedback can now be obtained from the burner, this such that when a flame respectively the thereby generated ionization current is detected the gas supply is maintained. When no flame is detected, the gas supply will after a time be shut off by the central processor.

According to a further development of the invention it is useful to provide the central processor with a clock signal input for time measurement. This ensures that different functions of the cooking appliance must function within a determined time, wherein after the predetermined time has elapsed and the function has not been set into operation, the safety device responds and closes the gas supply.

The invention further proposes to provide the central processor with a manually operated "on/off" signal input, with which it becomes possible to render the cooking appliance inoperative, also when one of the gas taps is opened by unauthorized persons (children).

By likewise providing the central processor with an input for a switch or sensor arranged at the gas taps, the position of the gas taps can also be automatically detected. It is likewise possible therewith to set the spark ignition into operation automatically. For this latter purpose the processor is preferably provided with a signal output for the ignition mechanism.

Finally, the processor can be provided with an output for an alarm signal circuit, with which an optical or auditive signal can be generated to indicate to the user that a function of the cooking appliance is nonactive.

BRIEF DESCRIPTION OF THE DRAWINGS

The invention is further elucidated with reference to the figure description hereinbelow of an embodiment. In the drawing.

DESCRIPTION OF THE PREFERRED EMBODIMENT

Figure 1:
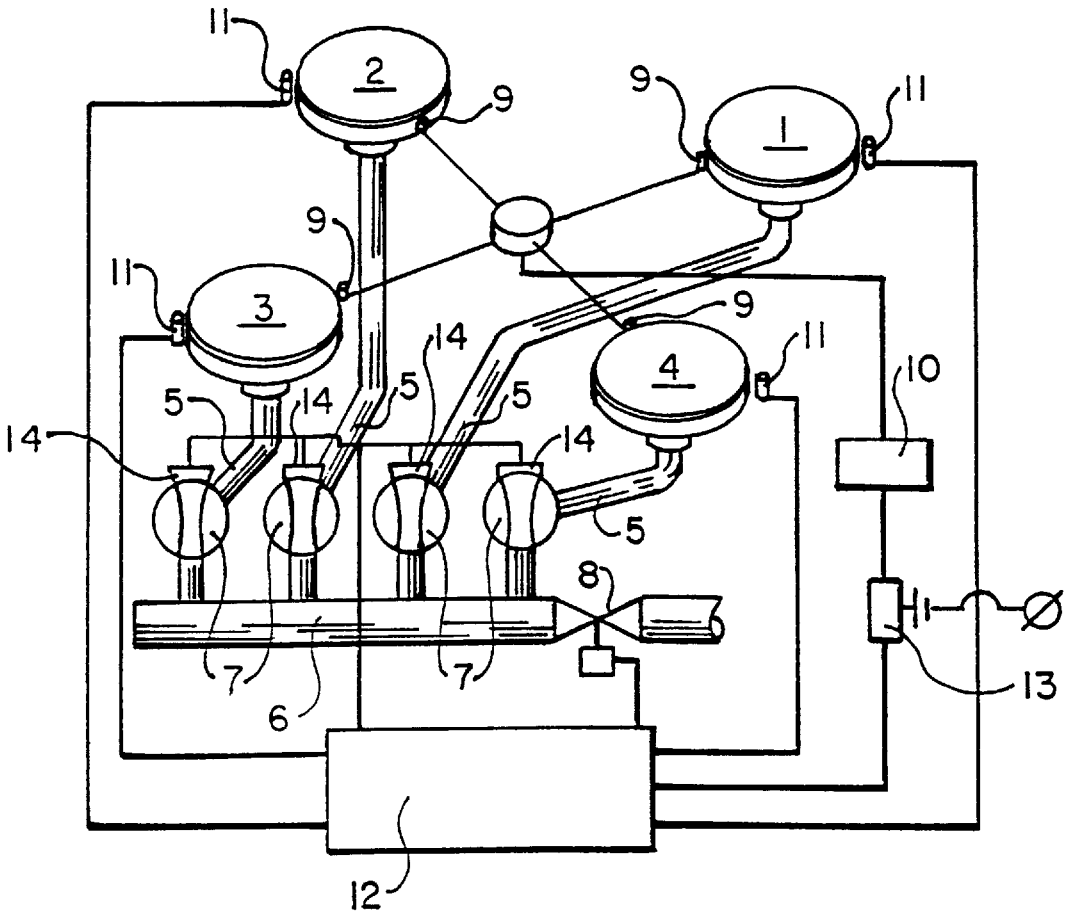
FIG. 1 shows a schematic view of a cooking appliance with four burners provided with a safety device according to the invention.

Designated in FIG. 1 with the numerals 1 to 4 are the four burners of the cooking appliance which are supplied by the gas main supply 6 of the cooking appliance via associated branch pipes 5. Accommodated in the branch pipe are gas taps 7 which can be operated manually in normal manner to regulate the gas supply as well as the flame height.

In the gas main supply 6 is arranged an electromagnetic valve 8 whereof the function is further elucidated hereinbelow. Each of the burners 1 to 4 is provided with an ignition mechanism 9 which is supplied via a central ignition transformer 10. The transformer 10 itself is supplied from the normal electricity mains supply of for instance 230 V. Each burner is also embodied with a sensor 11, in particular a sensor for measuring the ionization current in a flame at a burner. The sensors 11 are coupled to a central processor 12, which serves according to the invention to monitor and control the diverse functions of the cooking appliance, which are further elucidated hereinbelow with reference to FIG. 2. The central processor 12 is also embodied with an output for actuating the gas supply valve 8 and the electric and/or electronic switch 13 for the ignition transformer 10.

Figure 2:
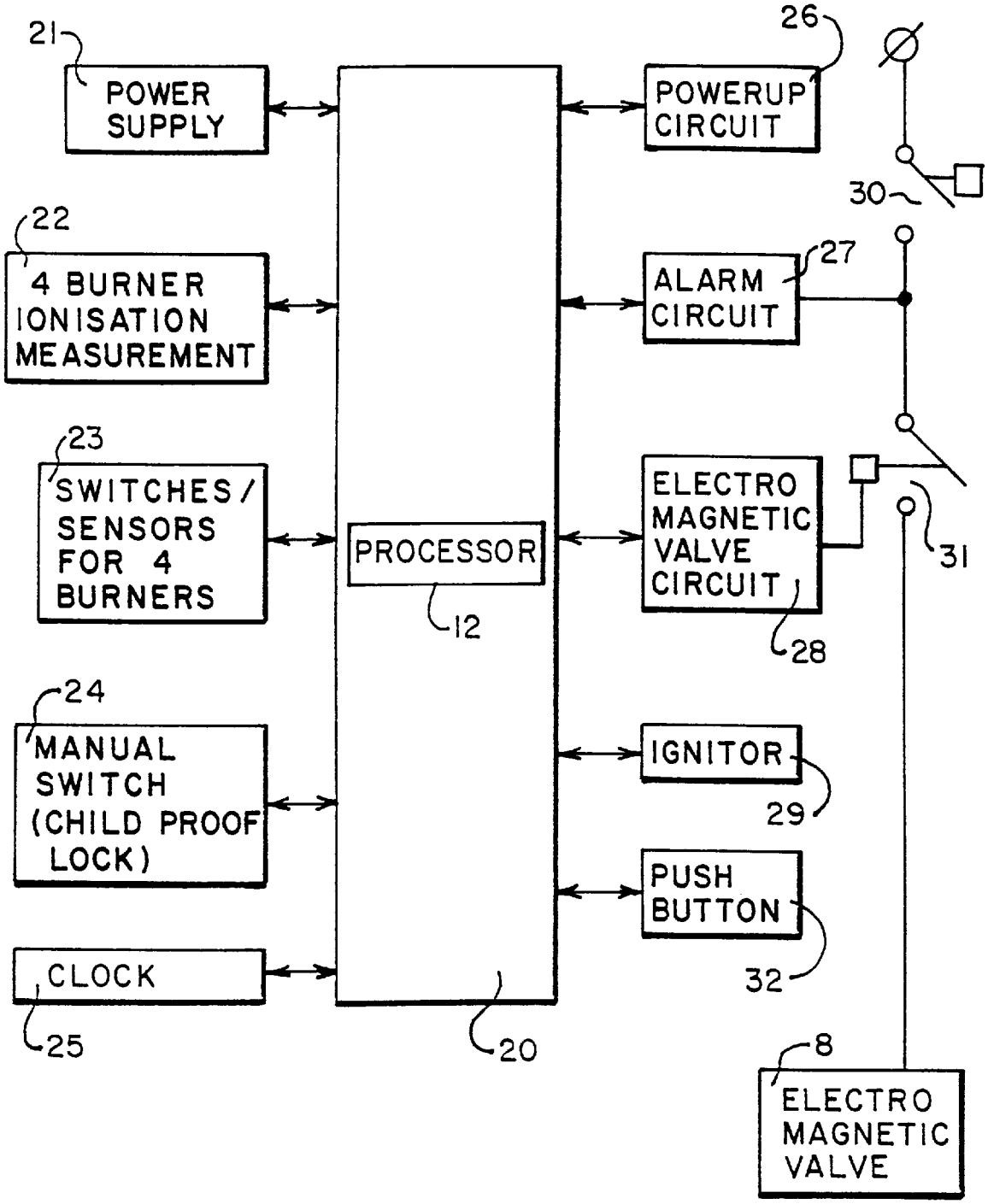
FIG. 2 is a block diagram of the safety device according to the invention.

FIG. 2 shows the processor in the block 20, which is coupled via the diverse inputs and outputs to the block 21 designating the power supply, the block 22 designating the ionization measurement by means of the sensors 11, the block 23 with which the position of a switch or sensor 14 averaged at the gas taps 7 is measured, the block 24 which is suitable for a manually operated switch which serves as childproof lock, the block 25 which shows the clock input for the processor, the block 26 for an additional voltage to supply the processor 20, the block 27 designating the alarm circuit, the block 28 designating the electromagnetic valve circuit for actuating the electromagnetic valve 8 in the gas main supply, and the block 29 designating the igniter, i.e. the transformer 10.

The electromagnetic valve is supplied from the electricity mains which can be for instance 230 V or from a low-voltage system of for instance 12 V. The alarm circuit is connected to an electric and/or electronic switch 30 in the power supply to the electromagnetic valve, which is connected in series to the second switch 31 for the electromagnetic valve actuated by the electromagnetic valve circuit.

The above described device operates as follows.

Rest/stand-by

At rest the electromagnetic valve relay and the alarm relay are not activated. The system is in the stand-by mode. In the case of for instance a power supply defect, both relays remain closed.

Start-up

One of the gas taps is operated: Safety time 5 seconds is started and the ignition transformer is activated. When no ionization current is measured on the corresponding burner within this safety time, the circuit is placed into failure locking (indication possible via 230 V lamp). When ionization is measured on the relevant burner, the ignition transformer is then switched off. The relevant burner remains operative as long as there is ionization current.

In operation

If an ionization current is measured corresponding with the relevant gas tap.

Loss of ionization current during operation

In case of ionization loss during operation, re-ignition takes place immediately for the safety time of 8 seconds. If the ionization current returns within the safety time the relevant burner remains in operation. If, however, no ionization current appears within the safety time, the unit drops into the locking, the electromagnetic valve closes and all burners are extinguished. Switching on again after locking is only possible by turning all the taps back to the zero position.

In case of a childproof lock, the electromagnetic valve is closed and the appliance locked, so that no reaction occurs when a gas tap is opened.

The appliance can be taken out of the childproof lock mode by for instance simultaneously opening and closing the taps 7 associated with burners 1 and 4 briefly (inside 1 second) or via a separate push button for 5 seconds. Opening one of the gas taps hereafter will open the electromagnetic valve and start the ignition.

The safety of the appliance according to the invention is ensured, and particularly so if the processor is embodied with an internal "watchdog", which will monitor optimum functioning of the relevant processor and take action if necessary.

The electromagnetic valve will be dynamically actuated by an electromagnetic valve relay contact and/or electronic circuit in series with a likewise dynamically actuated safety/alarm contact, so that the alarm relay will still switch off the electromagnetic valve in the case of an error in the electromagnetic valve control.

In the case of an intervention by the "watchdog" the circuit is placed in a safe situation.

A static error at random in the circuit will result in a safe situation.

If an ignition attempt does not succeed within the set safety time, the circuit enters a locking interruption, wherein the electromagnetic valve closes. This situation can only be ended by re-placing all the gas taps in the closed position (general reset). In the case one of the burners is defective, further cooking can take place normally by choosing one of the remaining three burners.

If within a determined period, for instance 3.59 hours, no operation has taken place, i.e. none of the taps has been opened/closed, the unit is automatically locked.

The invention is not limited to the above described embodiment.

I claim:

1. A safety device for a cooking appliance having a plurality of gas burners each connected to a gas main via a branch pipe, with each gas burner having a manually operated gas tap positioned in the branch pipe connected thereto for opening and closing the branch pipe, with the gas main having a gas valve positioned therein for controlling the supply of gas to the branch pipe, the device comprising:

a sensor positioned at each gas tap for detecting the position thereof; and a central processor connected to the gas valve and the sensors, wherein in response to detecting via the sensors the simultaneous opening and closing of two manually operated gas taps within a desired interval, the central processor causes the gas valve to open when the central processor detects via the position sensors the opening of at least one of the manually operated gas taps.

2. The safety device as claimed in claim 1 further including a manually operated switch connected to the central processor, wherein in response to activation of the manually operated switch, the central processor causes the gas valve to close and remain closed until the central processor detects via the sensors the simultaneous opening and closing of the two manually operated gas taps within the desired interval.

3. The safety device as claimed in claim 2, wherein the desired interval is 1 second.

4. A safety device for a cooking appliance having a plurality of gas burners each connected to a gas main via a branch pipe, with each gas burner having a manually operated gas tap positioned in the branch pipe connected thereto for opening and closing the branch pipe, with the gas main having a gas valve positioned therein for controlling the supply of gas to the branch pipe, the device comprising:

a sensor positioned at each gas tap for detecting the position thereof;

a push button; and a central processor connected to the gas valve, the sensors and the push button, wherein in response to detecting the activation of the push button for a desired interval, the central processor causes the gas valve to open when the central processor detects via the sensors the opening of at least one of the manually operated gas taps.

5. The safety device as claimed in claim 4 further including a manually operated switch connected to the central processor, wherein in response to activation of the manually operated switch, the central processor causes the gas valve to close and remain closed until the central processor detects via the activation of the push button for the desired interval.

6. The safety device as claimed in claim 2, wherein the desired interval is 5 seconds.

* * * * *